United States Patent [19]

Joshi et al.

[11] Patent Number: 4,893,670

[45] Date of Patent: Jan. 16, 1990

[54] INTEGRAL RADIATOR HOSE AND OIL COOLER

[75] Inventors: Shrikant M. Joshi, Getzville; Lee C. Whitehead, Middleport; Frederick V. Oddi, Orchard Park, all of N.Y.

[73] Assignee: General Motors Corporation, Detroit, Mich.

[21] Appl. No.: 356,102

[22] Filed: May 24, 1989

[51] Int. Cl.[4] ..... B60H 1/00; B61D 27/00; F28F 21/06; F01M 5/00

[52] U.S. Cl. ..... 165/40; 165/41; 165/46; 165/51; 165/154; 165/179; 165/905; 123/41.33; 123/196 AB; 184/104.1

[58] Field of Search ..... 165/46, 41, 51, 154, 165/905, 38, 40, 179; 123/41.33, 196 AB; 184/104.3, 104.1

[56] References Cited

U.S. PATENT DOCUMENTS

| | | | |
|---|---|---|---|
| 3,070,975 | 1/1963 | Cornelius | 165/51 |
| 3,105,708 | 10/1963 | Esly | 165/51 |
| 3,750,744 | 8/1973 | Bouras | 165/148 |
| 3,779,308 | 12/1973 | Buhrmann et al. | 165/51 |
| 3,802,491 | 4/1974 | Plank, Jr. et al. | 165/154 |
| 3,877,514 | 4/1975 | Beck | 165/38 |
| 3,888,647 | 6/1975 | Breeden et al. | 165/40 |
| 4,013,122 | 3/1977 | Long | 165/154 |
| 4,167,969 | 9/1979 | Ritzenthaler | 165/51 |
| 4,575,003 | 3/1986 | Linker et al. | 165/41 |

FOREIGN PATENT DOCUMENTS

| | | | |
|---|---|---|---|
| 0010818 | 5/1980 | European Pat. Off. | 165/905 |
| 2637511 | 2/1978 | Fed. Rep. of Germany | 165/905 |
| 0731264 | 4/1980 | U.S.S.R. | 165/179 |
| 0883640 | 11/1981 | U.S.S.R. | 165/179 |
| 1198367 | 12/1985 | U.S.S.R. | 165/179 |

*Primary Examiner*—John Ford
*Attorney, Agent, or Firm*—R. L. Phillips

[57] ABSTRACT

An oil cooler and a radiator hose are combined in an all polymer structure. Generally concentric hoses provide two coolant paths with the wall of the inner hose providing heat transfer from one fluid to the other. The hoses are flexible or can be formed to conform to desired radiator hose routing. The hoses have deflectable vanes extending from their walls into the fluids to flex according to flow rate. The vanes induce turbulence to improve the thermal transfer especially at low flow rates but deflect at high flow rates to minimize pressure drop due to the vanes.

3 Claims, 1 Drawing Sheet

INTEGRAL RADIATOR HOSE AND OIL COOLER

FIELD OF THE INVENTION

This invention relates to heat exchangers and particularly to an oil cooler combined with an automotive radiator hose.

BACKGROUND OF THE INVENTION

In automotive vehicles it is common practice to cool the engine by pumping hot engine coolant through a radiator hose to a radiator which dissipates heat to ambient air and then returning the coolant through another radiator hose. Such radiators have efficient metallic tube and fin structures for transmitting heat to the air, and reservoirs or tanks for coupling the coolant between the radiator hoses and the tubes. The tanks may be metal but polymeric materials have become increasingly more common in usage.

In many cases the engine lubricating oil or the transmission oil also is cooled. A variety of cooling practices have been used such as separate heat exchangers for the oil or some combination of the oil and coolant heat exchange function. Many vehicles employ an oil cooler which resides within the radiator tank to effect heat transfer from the oil to the engine coolant. The size and complexity of the latter type of oil cooler varies according to the required thermal capacity but, in general, they are brazed assemblies built up of tubes and fins having inlet and outlet fittings extending through the radiator tank. Such structures have many parts and are thus expensive to manufacture, and they increase the size and complexity of the radiator tank.

It is already known, as shown for example in U.S. Pat. No. 4,545,334 to Nakagawa et al, to use in-line oil coolers comprising concentric metal pipes. In that patent the cooler structure is rigid, not conformable to radiator hose routings. The structure comprises many parts, including a triple-walled pipe structure, separate fins within the pipes and separate nipples attached to the pipes, apparently welded together.

SUMMARY OF THE INVENTION

It is therefore an object of the invention to provide a flexible oil cooler having the thermal advantage of heat transfer to the engine coolant and avoiding an intrusion into the radiator tank.

It is another object of the invention to provide an oil cooler without the complexity and high cost of traditional cooler structure.

The invention is carried out in an automotive cooling system, by a compound radiator hose for transmitting coolant flow from a radiator to an engine and for cooling oil, comprising: an outer hose for coupling to either of the radiator or the oil source, an inner hose within the outer hose and radially spaced therefrom to provide a first passage between the inner and outer hoses and a second passage within the inner hose, the inner hose having a thermally conductive wall, and means for coupling the inner hose to the other of the radiator or the oil source, whereby heat from the oil is conducted through the wall of the inner hose to the coolant passage so that coolant in the coolant passage can cool the oil.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE PREFERRED EMBODIMENT

The ensuing description is based on an oil cooler arrangement specifically for a transmission oil cooler but it should be understood that it is equally applicable to a lubricating oil cooler. The term "hose" as used in the description means a tubular conduit of flexible or readily formable material which can be made to a desired routing, as contrasted to a rigid tube or pipe typically made of metal.

Figure 1:
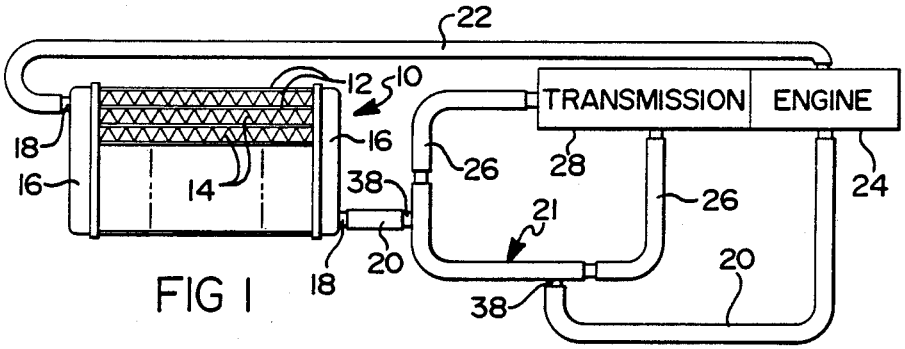
FIG. 1 is a schematic diagram of an engine and transmission cooling system containing a radiator hose and oil cooler arrangement according to the invention.

FIG. 1 shows a radiator 10 having horizontal tubes 12 for carrying coolant and fins 14 between the tubes to enhance heat transfer to the ambient air. Tanks 16 at opposite sides of the radiator 10 enclose the ends of the tubes 12 and have inlet and outlet fittings 18 connected to radiator hoses 20 and 22. The hoses lead to the engine 24 and carry coolant between the radiator 10 and the engine. The hose 20 incorporates a combined hose and oil cooler 21, best shown in FIG. 2, which is coupled by lines 26 to a transmission 28.

The hose and cooler combination 21, also called a cooler 21, is made of polymer material to permit bending or shaping to fit in preferred routings in the vehicle engine compartment. There are several polymer materials presently known to be suitable to constructing the cooler 21. Two such materials are 40% aluminum flake type 6/6 and type 6/12 nylon manufactured by AKZO Engineering Plastics in Evansville, Ind. The cooler 21 is a one-piece double tube structure with the tubes substantially concentric. An outer tube 30 surrounds an inner tube 32. The inner tube 32 defines one fluid flow channel and the annular space 34 between the tubes defines a second flow channel. The ends 36 of the inner tube 32 extend outwardly through the wall of the outer tube 30 and terminate in flanged fittings 38 for coupling to the hose 20. The double tube structure may be manufactured by molding in one piece or may be made in two or more pieces and joined by adhesive or by ultrasonic welding, for example. Thus with this arrangement engine coolant will flow through the inner tube 32 and transmission oil will flow through the annular channel 34. Of course the connections can be reversed so that the oil will be contained in the inner tube 32 and the coolant in the annular channel. For best performance the fluid flows will be in opposite directions.

Figure 2:
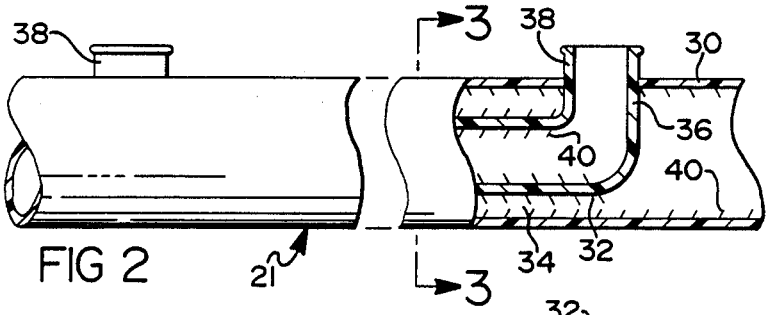
FIG. 2 is a partly broken away elevation of a combined radiator hose and oil cooler according to the invention.
Figure 3:
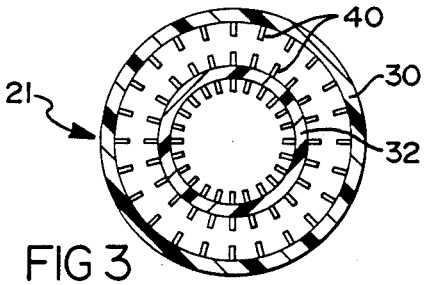
FIG. 3 is a cross sectional view of the combined radiator hose and oil cooler taken along line 3—3 of FIG. 2.
Figure 4:
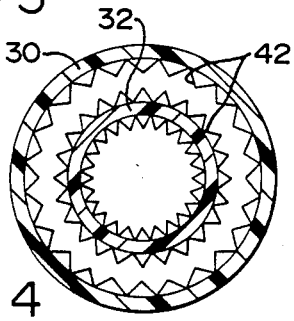
FIG. 4 is a cross sectional view of the combined radiator hose and oil cooler according to another embodiment of the invention.

Heat transfer between the fluids and the polymer tube walls is promoted by increasing tube surface area and by increasing turbulence in the fluid flow. FIGS. 2 and 3 show vanes 40 on each tube wall in contact with the flow. The vanes primarily cause turbulence thereby preventing laminar flow and the consequent build-up of thermal layers at the tube surface. As shown in FIG. 4, other types of ribs, bumps 42 or controlled surface roughness can be used to cause the turbulence and to increase surface area as well. The vanes are of particular interest since they deflect with fluid flow to offer an advantage with regard to pressure drop.

Figure 5:
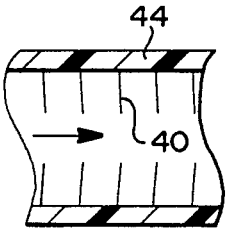
FIGS. 5 and 6 are schematic diagrams of the effect of low and high fluid flow rates, respectively, on vanes protruding from tube walls.
Figure 6:
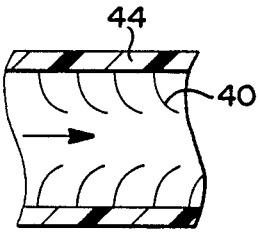

Vanes 40 extending into the fluid passage do introduce a pressure drop. Because of the vane flexibility the fluid flow causes deflection which lowers the pressure drop to values less than rigid vanes would cause. In response to fluid flow forces, the vanes extend further into the passage during low flow rates in the passage than during high flow rates. This is illustrated in FIGS. 5 and 6 for low flow rate and high flow rate, respectively. Assuming the vanes 40 are molded to the tube wall 44 to extend perpendicular to the wall in the absence of flow, they will be deflected a small amount in the direction of flow at low flow rates (FIG. 5) and will be deflected a greater amount at high flow rates (FIG. 6). Rigid vanes would cause large pressure drop at high flow rates but the deflecting vanes offer much less resistance along with less turbulence. Still the flexible vanes induce large turbulence levels at low flow rates. This allows a very favorable tradeoff between heat transfer and fluid pressure drop.

Figure 7:
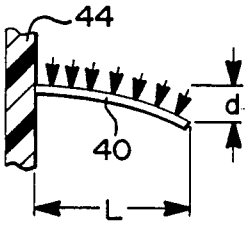
FIG. 7 is a diagrammatic view of the vane and deflecting forces applied thereto.

The net force acting on all the vanes is directly proportional to the product of the pressure drop in the pipe and the area of the vanes. FIG. 7 shows an individual vane 40 having a length l, a modulus of elasticity E, and a moment of inertia I. For a single vane, if the total force on the vane is W, the deflection $d=W13/8EI$. This equation can be used to design the automatically deflecting vanes which will control the water turbulence in the pipe to a predetermined level.

The embodiments of the invention in which an exclusive property or privilege is claimed are defined as follows:

1. In an automotive cooling system, a compound radiator hose for transmitting coolant flow from a radiator to an engine and for cooling oil, comprising:

an outer hose for coupling to one of the radiator and the oil source, an inner hose within the outer hose and radially spaced therefrom to provide a first passage between the inner and outer hoses, and a second passage within the inner hose, means for coupling the inner hose to the other of the radiator and the oil source, whereby heat from the oil is conducted through the wall of the inner hose to the coolant passage so that coolant in the coolant passage can cool the oil, and the inner hose constructed of polymer material and having flexible vanes extending from at least one surface thereof into the respective passage for causing turbulence in the flow through the respective passage, the vanes being deflected by fluid flow to extend further into the passage during low flow rates in the passage than during high flow rates whereby turbulence in the flow is increased at low flow rates and pressure drop caused by the vanes is reduced at high flow rates.

2. The invention as defined in claim 1 wherein the inner hose has said flexible vanes extending from both surfaces thereof into the respective passages.

3. The invention as defined in claim 1 wherein the inner hose has ends extending outwardly through the wall of the other hose, means for coupling one of the passages to a radiator and to an engine to carry a coolant, and means for coupling the other of the passages to a hot oil source for oil flow therethrough, whereby heat from the oil is conducted through the inner hose wall to the said one passage so that coolant in the said one passage can remove heat from the oil with the aid of the vanes.

* * * * *